US006142288A

United States Patent [19]

Hotkowski et al.

[11] Patent Number: 6,142,288

[45] Date of Patent: Nov. 7, 2000

[54] FANFOLD SHEET FEEDER HAVING STACK POSITIONER

[75] Inventors: Peter D. Hotkowski, Chester; Frank A. Todaro, Saybrook; Daniel J. Williams, Westbrook; Brian C. Richardson, Bozrah, all of Conn.

[73] Assignee: Asterisk, Inc., Old Saybrook, Conn.

[21] Appl. No.: 09/187,077

[22] Filed: Nov. 6, 1998

Related U.S. Application Data

[60] Provisional application No. 60/063,986, Nov. 6, 1997.

[51] Int. Cl.[7] ..... B65G 47/24

[52] U.S. Cl. ..... 198/409; 198/403

[58] Field of Search ..... 198/409, 403

[56] References Cited

U.S. PATENT DOCUMENTS

| | | | |
|---|---|---|---|
| 4,874,078 | 10/1989 | Meyer | 198/409 |
| 5,435,432 | 7/1995 | Tacchi et al. | 198/409 |
| 5,743,374 | 4/1998 | Monsees | 198/409 |

OTHER PUBLICATIONS

The Laser Feed Company "How To Use The Laserfeed Splice Rite®", unknown date, one page instruction sheet.
Laserlink Corporation, "LC400A Fanfold Feeder", catalog sheet, unknown date, one page.
Laserlink Corporation, "LC4000 Splice Cart Unit (SCU)", catalog sheet, unknown date, one page.
Energy Saving Products Co. "The Laserfeed Company Document Processing Solutions", catalog sheet, unknown date, one page.

*Primary Examiner*—Christopher P. Ellis
*Assistant Examiner*—Mark A Deuble
*Attorney, Agent, or Firm*—C. G. Nessler

[57] ABSTRACT

Apparatus for feeding stacks of fanfold sheets is comprised of a belt conveyor, a positioner, and a splicer. The conveyor feeds stacks deposited thereon by the positioner toward the discharge end. The postioner is comprised of a U-shape bin which receives fanfold stacks and then turns them over and deposits them at a desired position along the length of the conveyor belt. In one embodiment, the stacks are lifted from the floor level. In another, the positioner translates along the base of the conveyor and includes a mechanism which automatically locks the positioner in place during loading. A splicer is positioned over the belt. Header and footer ends of adjacent stacks are run to the splicer where they are precisely clamped and then adhesively joined together, on the top side or underside, as desired. The conveyor has a sensor and drive system which automatically advances stacks toward the discharge end and signals the operator when there is a need to reload. The conveyor belt is powered by a timing belt drive system where the timing belt runs around the conveyor belt roller, to both frictionally engage the conveyor belt and cause it to crown up.

17 Claims, 11 Drawing Sheets

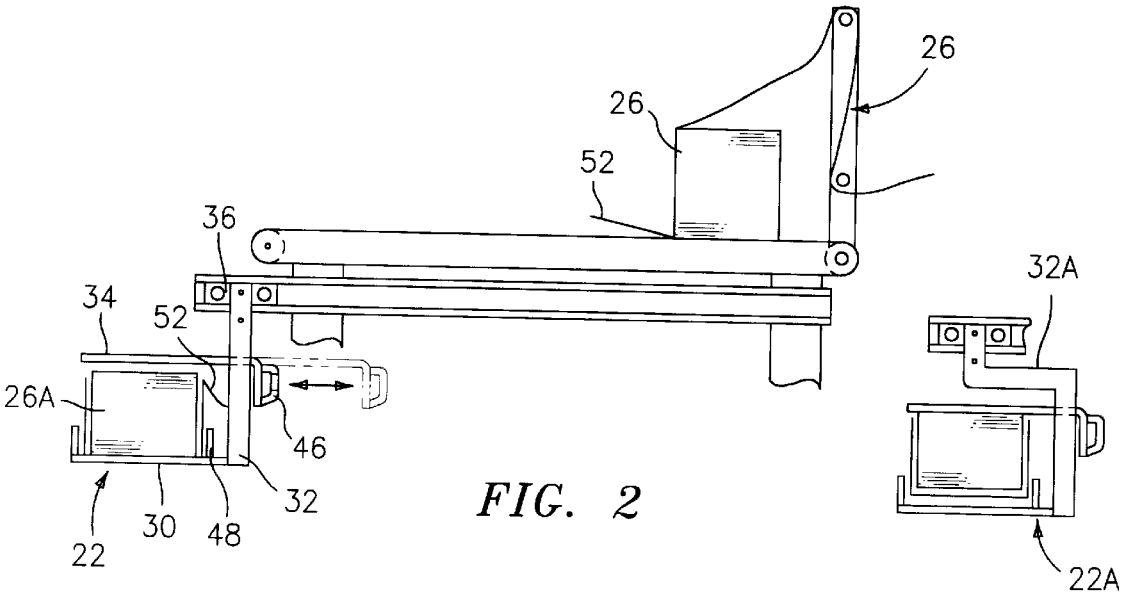
FIG. 2
FIG. 5
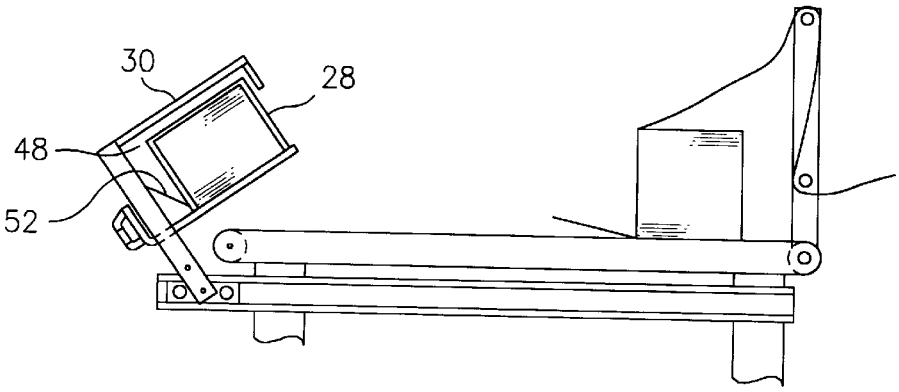
FIG. 3
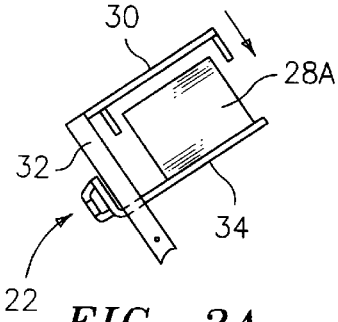
FIG. 3A
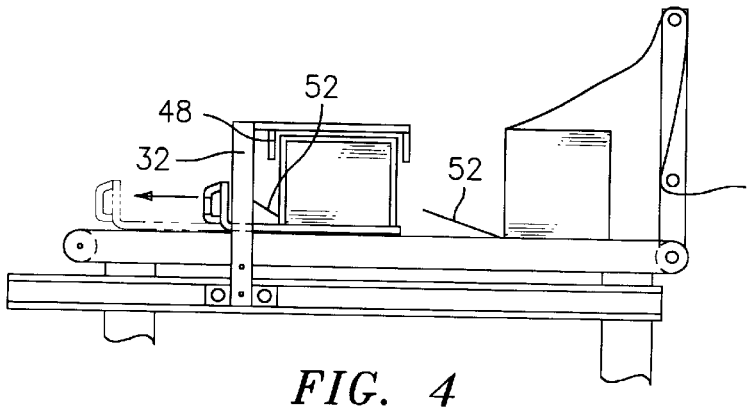
FIG. 4

FANFOLD SHEET FEEDER HAVING STACK POSITIONER

This application claims benefit of Provisional Patent Application No. 60/063,986, filed Nov. 6, 1997.

TECHNICAL FIELD

The present invention relates to devices for handling paper, in particular fanfold paper sheet, such as the type utilized in the printing industry.

BACKGROUND

When printing plants and other manufacturing plants use fanfold sheet paper, they often have a need to continuously handle, position and splice sheets. While fanfold sheet is commonly supplied in small cartons of the type an ordinary working person can lift, the industry aim is to efficiently and continuously run printing and finishing machines with minimum operator attention. Generally, a way of fulfilling the aim has been as follows. There is an input feed device, such as a conveyor or static surface, on which the stacks of fanfold sheet are placed, and from which a printing or finishing machine draws the sheet. An operator opens a new carton to expose the full top surface of the fanfold stack within, and pulls out one or more pages from the new stack in the carton, to provide a so-called footer, which is a sheet end suited for attachment to a so-called header from stack which will be processed next. The operator lifts the new carton onto the work surface, with dexterity tips the carton rapidly over so it is upside down and the stack is resting on the conveyor with the footer sticking out from under the stack. The operator removes and discards the carton by lifting it vertically, thus fully exposing the new stack. The operator then places a second stack on the surface in the same manner. The operator then splices the footer sticking out from the first stack to a header, or top-most sheet end, of the second stack. The operator will slide any new stacks in close proximity to the earlier-placed stacks so that the maximum number of stacks can be positioned on the conveyor or table.

While the prior art system is mostly effective, it does require a certain physical strength and dexterity on the part of the operator. Further, the operator may not be adequately motivated, or able, to move a new stack in close proximity to the prior stack. The operator also may also not check the feeder in timely fashion to see if additional stacks ought be added. Thus, a printer or finishing machine being fed several stacks of fanfold pages may run out of sheet to process, and become idle and non-productive.

Although automated input feeders exist, they are typically relatively complex and expensive systems. Of the various types of feeders in commercial use, none seem to adequately lessen the need for either or both of brute force and dexterity on the part of the operator, at a reasonable price.

A further issue in the prior art involves the joining of the header and footer. Typically, fanfold paper will have perforated edges, which are engaged by sprockets on the printing machine being fed. Thus, it is highly desirable that the hole-to-hole spacing across the splice be maintained; and also that the splice joints be secure and consistent, and quickly and easily made. There are, of course, a variety of devices for laying down tape on objects, and undoubtedly devices specialized for making sheet splices. For feeders of the type with which the invention is concerned, it is desirable that the splicer achieve the objects mentioned just above in a simple and effective way.

SUMMARY

An object of the invention is to provide a means for continuously feeding fanfold sheet to a sheet processing device, where the fanfold sheet is provided in stacks of the size contained in ordinary cartons; and, to lessen the need for operator strength, skill and dexterity. A further object of the invention is to provide a dependable and efficient means for splicing fanfold and other paper sheets together. Another further object is to provide an improved conveyor control and drive mechanism for use in handling fanfold stacks and other things.

In accordance with the invention, apparatus for feeding positioning and feeding fanfold stacks comprises a stack transporter, such as a conveyor belt running in a loop around rollers, for moving stacks laterally toward the discharge, or second, end thereof, and a stack positioner for rotating and depositing stacks on the transporter at the input, or first, end of the transporter. The positioner has a bin with an opening which first faces away from the second end. The stack is inserted in the bin and one or more pages are pulled from the stack. The bin is then rotated so the opening faces toward the second end, thus turning the stack upside down; and, the positioner with the stack in the bin is moved laterally along the transporter length, whereupon the stack is deposited upside down on the transporter at a desired location. The one or more pages which had been pulled from the stack earlier now stick out from beneath the stack, providing the footer which is joined to the header of the succeeding stack which will be likewise deposited. The positioner may be alternatively attached to the transporter structure, or be separate from it, for servicing multiple transporters. In one embodiment, the stack positioner receives the stack at floor level, i.e., lower than the conveyor belt, and lifts it vertically while turning it upside down. In another embodiment, the bin is at a constant elevation just above the conveyor belt. Preferably, the bin has a U-shape cross section, an adjustable partition to accommodate different stack heights, and a sidewall opening to facilitate handling of footer pages.

Preferably, a conveyor belt transporter is fitted with sensors and a control system, so that stacks moved by the belt to the discharge end are sensed. A first sensor system stops the belt motion when a first stack reaches the discharge end; and, a second sensor system works in combination with the first to signal the operator to reload the machine, if a second stack is not following the first stack which has reached the end of the conveyor. Preferably, there is a stanchion and roller system at the discharge end of the transporter, to facilitate the feeding of sheet from the transporter to the device being fed.

In further accord with the invention, a splicer is positioned along the length of the transporter, for joining the footer of a first stack to the header of a second stack. The splicer is comprised of a clamp assembly and a tape dispenser which moves along a closely defined path along the length of the top of the clamp assembly, as butting ends of sheets from adjacent stacks are held accurately in close proximity.

Preferably, the transporter comprises a conveyor belt which is looped around opposing end rollers, and the conveyor belt drive comprises a drive belt running around one end roller so it is captured between the conveyor belt and the roller surface. Preferably, the drive belt runs within a circumferential groove of the end roller, at the center of the roller, which groove is smaller in depth than the thickness of the belt. It runs to a motor-driven driver roller positioned within the loop of the conveyor belt. When the drive roller is rotated, the drive belt is moved around the conveyor end roller. The frictional engagement of the conveyor belt with the outer surface of the drive belt causes the conveyor belt to move, whereupon the conveyor belt roller is rotated.

The foregoing and other objects, features and advantages of the invention will become more apparent from the following description of preferred embodiments and accompanying drawings.

BRIEF DESCRIPTION OF THE DRAWINGS

FIGS. 2, 3, and 4 show serial motion of the apparatus of FIG. 1 during use.

FIG. 3A and FIG. 5 shows different embodiments of the positioner used in FIG. 1 apparatus.

DESCRIPTION

Described below are two principal embodiments of the present invention for handling, positioning and feeding stacks of fanfold papers. In the description it is assumed, by way of example, that the apparatus is being used in an operation where fanfold sheet is being printed. However, the apparatus may be used with any of a variety of other machines, most particularly finishing machines.

The first embodiment described below has a stack handling mechanism which is more elaborate than the second, in that the first lifts the stack of sheets from the floor level. Features which are described for one embodiment will usable in various obvious ways with the other embodiment. And, the splicer, the stack lateral motion control system, and the conveyor belt drive system, will be understood to be useful in different combinations and separately for other applications than the particular use of feeding stacks of fanfold papers.

Fanfold sheet is a term of art used herein. It refers to a continuous piece of sheet material (which commonly comprises cellulose pulp but may comprise some other material such as plastic, etc.), which has periodic transverse creases or serrations, so that when it is received at a point, the sheet folds in a zig-zag fashion to form a stack. Fanfold sheet is also commonly referred to as fanfold paper, fanfold pages, and fanfold forms. The individual segments of a fanfold sheet are referred to as pages herein. Fanfold sheet in stack form is generally handled by being placed in cartons, and at some places the shorthand "carton" is used to refer to a stack of fanfolded paper in a carton. It will be appreciated that the invention will be equally applicable to fanfold stacks which are freestanding and not in cartons or other containers.

Figure 1:
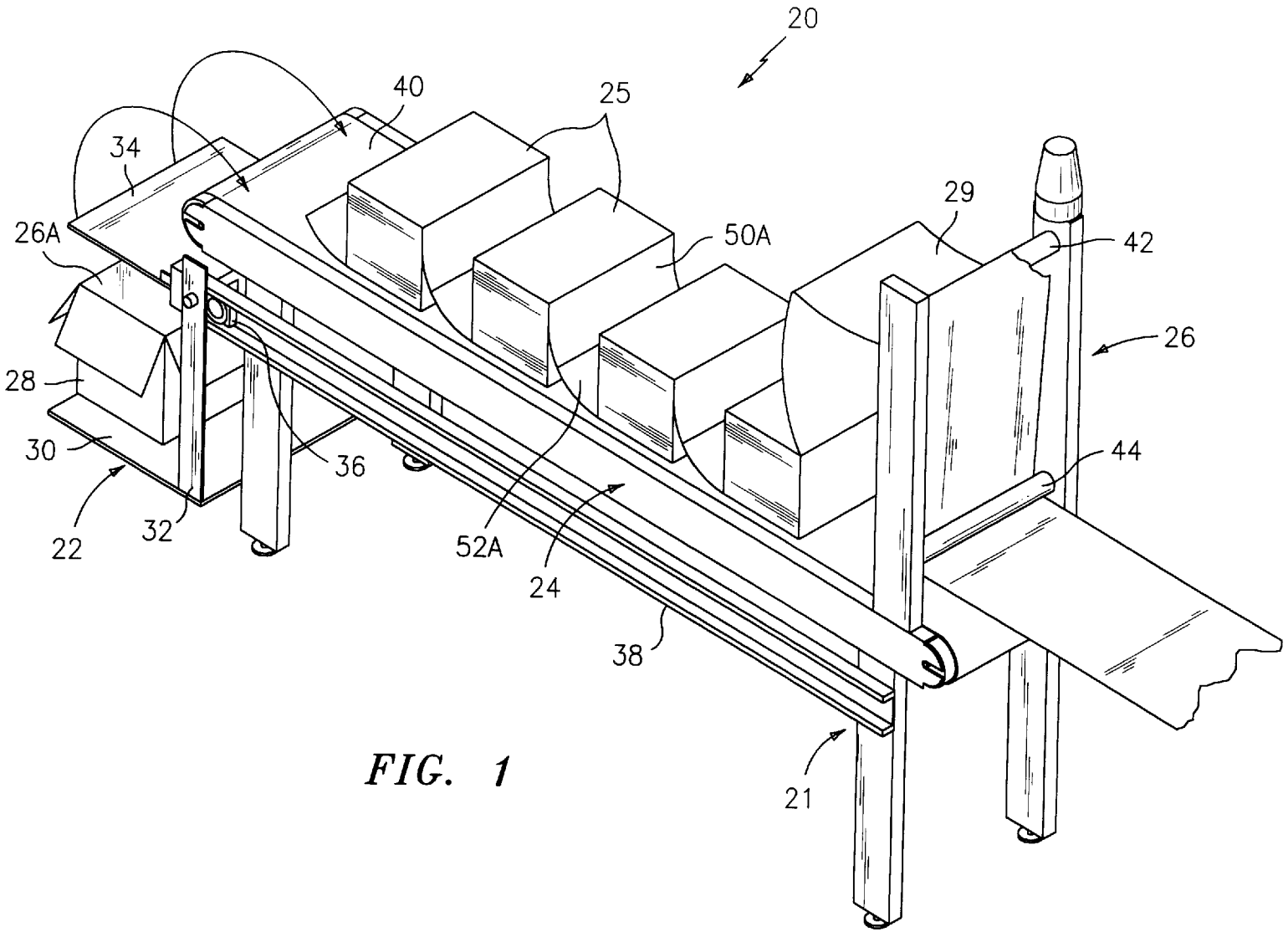
FIG. 1 shows in perspective apparatus for feeding stacks of fanfold sheet, wherein a stack is lifted from floor level and conveyed toward a printer or other machine.

The first principal invention embodiment is apparatus 20, shown in FIG. 1, as it would appear during the supplying of fanfold sheets to a printer. The apparatus comprises a machine base 21, a conveyor 24 running in a loop around conveyor rollers at opposing ends of the machine base, a roller stanchion assembly 26 at the discharge end of the machine, and stack positioner 22 at the input end of the machine. Stacks 25 of fanfold sheet, previously put in place in a manner which will be described, rest on the belt 40 of the conveyor. The construction is conventional, and there is an unshown flat metal plate running between the rollers, to support the belt and stack weight. Pages 29 from the front-most stack pass over rollers 42, 44 of the stanchion assembly and to an unshown printer. The bottom-most page(s), or footer, 52A of any stack is connected to the topmost page(s), or header, 50A of the following stack. Thus, when a first stack is exhausted, the printer will draw paper from the succeeding stack. The conveyor belt 40 advances as required, either manually or under action of automatic control which is described below, to move stacks nearer to the stanchion at the discharge end of the apparatus, as the prior stacks are consumed.

The positioner 22 is shown in rest position in FIG. 1. FIGS. 2–4 show sequentially how it operates. In these and other Figures, the carton 28 is shown with its side cutaway, so the stack within is exposed to view. The positioner 22 is comprised of a platform 30, which is adapted to receive a carton 28 containing a new fanfold paper stack 26A, when the positioner is in its rest position. The platform is attached to a pair of opposing arms 32. Each arm is pivotably supported off a trolley 36. The trolleys ride along channels 38 which run along each side of the conveyor. Mounted on the arms, spaced apart from and parallel to the platform, is shutter 34. The shutter is adapted to slide laterally, transverse to the arms, as shown in FIGS. 2 and 4.

To use the apparatus, a carton having a new stack is opened and slid onto the platform when positioner 22 is in its rest position, as shown in FIGS. 1 and 2. The topmost page(s) is pulled out of the carton, to provide a footer 50. The shutter may be slid out of the way to facilitate the foregoing operations. When the carton is in place on the positioner platform, and the shutter is restored to its rest position, the main structure of the positioner is rotated upwardly as indicated by the arrows in FIG. 1 and as is shown in FIG. 3. The rotation can be accomplished manually, using unshown levers and handles, with or without a spring or counterweight assists, or by a powered actuator. During such rotation, bracket 48, shown in FIGS. 2–4, retains the carton within the space between the shutter and platform during rotation. A stop, not shown, connected to the trolley, stops the positioner from passing beyond the inverted vertical position shown in FIG. 4. The positioner is moved laterally, by means of the trolley supports, during or after rotation, so that new stack will be as close as desired to the prior stack as illustrated by FIG. 4.

It will be appreciated from the foregoing that the combination of platform 30, bracket 48, and shutter 34 form an essentially U-shape bin into which the carton and stack are slid. This will be even more fully appreciated from the description of the second principal embodiment which follows. In the rest position, or first orientation of the bin, the bin opening faces away from the discharge end of the conveyor. When rotated through nominally 180 degrees of arc, to the second orientation, for depositing of a stack on the conveyor, the bin opening faces toward the discharge end of the conveyor.

When the positioner bin is in the second orientation, where it is very close to, or touching the conveyor belt surface, the shuttle is moved laterally, as indicated by the arrow in FIG. 4, to pull it out from underneath the carton and stack, which is held in position relative to the arms 32 by bracket 48. Then the positioner is moved back toward the receiving end of the conveyor, the shuttle is restored to its initial position, and the bin is restored to its starting position, ready to receive a new stack. The operator then manually lifts the carton from the stack which was just deposited on the conveyer, and pulls the topmost page(s) from the stack, and splices it to the footer 52 of the previously deposited stack.

As illustrated by FIG. 3A, there is one additional step and part motion that may be carried out in a variation of the positioner. The shutter is slidable along the length of the arms 32 of the positioner. Thus, if the carton is smaller than the space between the platform 30 and shutter 34, then before rotating the postioner 22, the platform 30 is translated toward the shutter. See the arrow in FIG. 3A. This minimizes "shucking" of the carton during the rotation step.

Variations may be made from the embodiment just described, As shown in FIG. 5, postioner 22A may have arms 32A that are dog-leg shape, to place the center of mass of the carton/stack beneath the pivot point. In another alternative, the positioner may be supported from one side of the conveyor only, rather than both sides, so the bin support structure cantilevers over the belt, thus enabling somewhat better operator access. In still another alternative, the positioner may be mounted on one or more wheeled dollies, rather than from the conveyor base, so it can roll along the floor on either side of the conveyor, or so it can straddle the conveyor, thus eliminating the need for the trolleys and channels 38. Such dolly configurations enable one positioner to be used with different printing machine and associated conveyors.

The stanchion assembly 26 is optional. It facilitates the feeding of sheets to the conventional input elevation of printers and the like. In an alternative stanchion assembly embodiment, one of the vertical stanchion supports for the rollers 42, 44 is removed, so the rollers are cantilevered, to provide better access to the fanfold sheet flow path. In a preferred embodiment, means are provided for lessening tension in the sheet due to stop-and-go of the device being fed. Preferably, the sheet runs on an angled path around at least one roller 42, 44 which has a comparatively low mass and which is spring-loaded against the force on the roller created by the sheet. The length of the sheet path is decreased by movement of the low mass roller, in inverse sense to changes in sheet tension due to acceleration and deceleration of the sheet.

Figure 6:
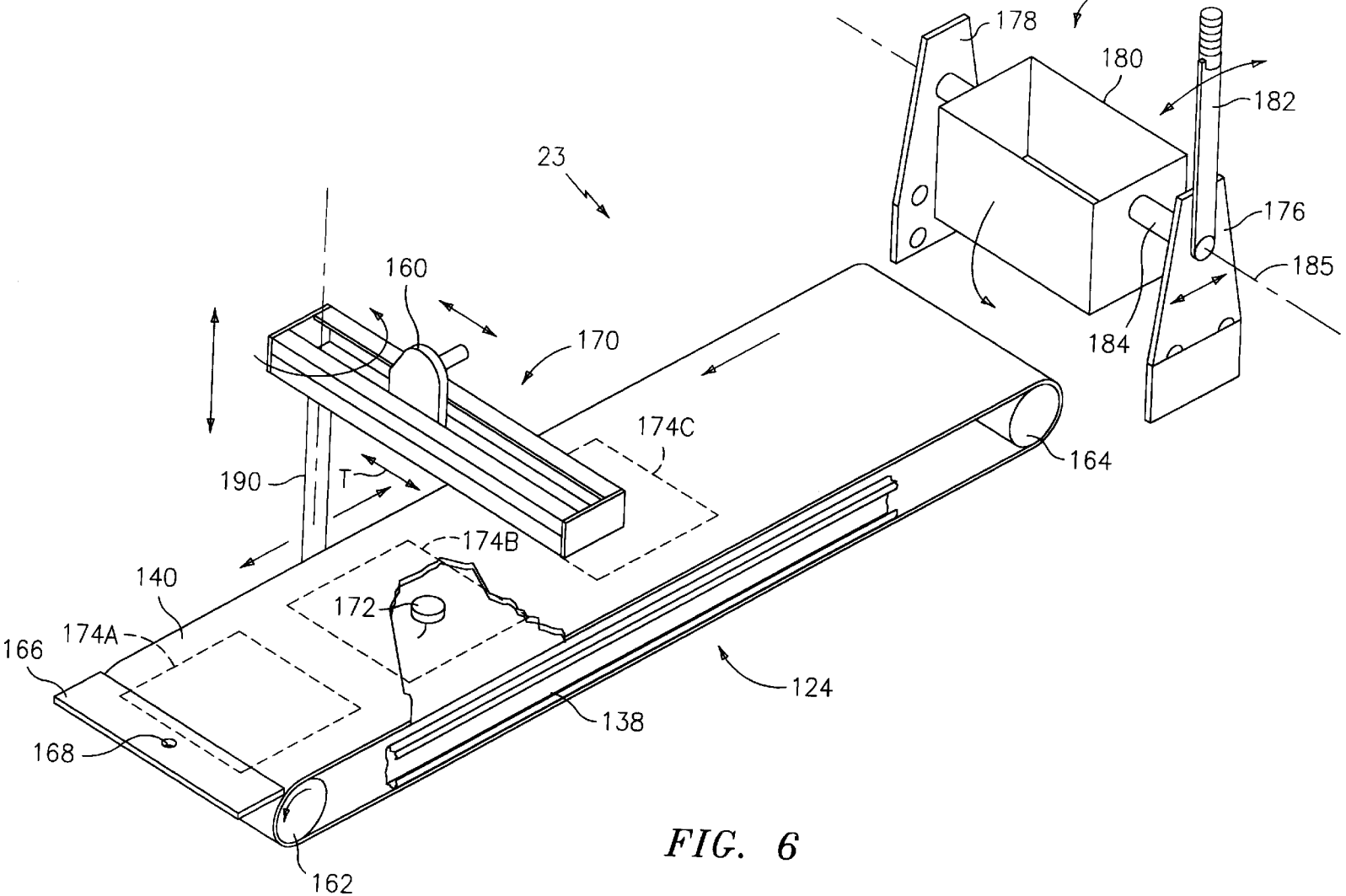
FIG. 6 shows in perspective apparatus for automatically feeding and splicing stacks of fanfold sheet.

The second principal embodiment 23 of the invention is shown in FIG. 6. Omitted from this view for simplicity of illustration are the substantial part of the machine base on which the conveyor 124 and other parts mount, together with the stanchion at the discharge end (now on the left in the Figure) of the conveyor. It will be understood they are preferably present, in accord with the description of apparatus 20. Stacks of fanfold sheets are placed on the conveyor belt, as described above. For simplicity, their locations are indicated by the phantom footprints 174A, 174B, 174C.

The apparatus 23 in FIG. 6 is comprised of the conveyor 124, a splicer 170, and a positioner 122 which acts to rotate and laterally locate stacks of sheets in cartons or otherwise. The positioner and splicer are both translatable along the length of the conveyor, being mounted in siderail beam structures 138 of the base. Details about the splicer mounting and splicer post 190 are provided near the end of this description. In a nutshell, the splicer has several degrees of freedom, so it can be moved laterally, lengthwise and vertically relative to the sheet and the belt, rotated out of working position.

Figure 12:
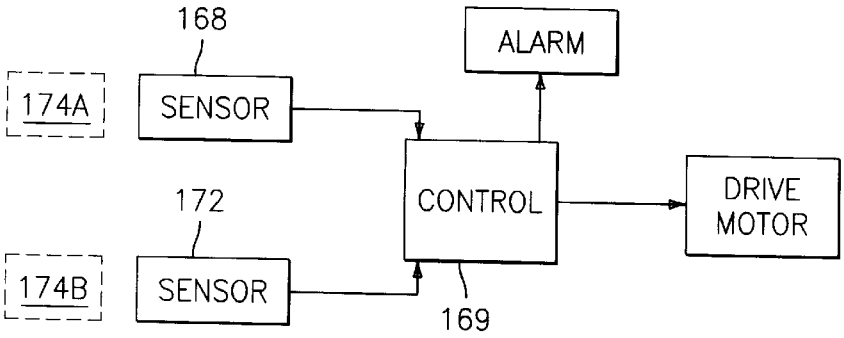
FIG. 12 is a flow diagram illustrating the functioning of the conveyor drive system.

The conveyor 124 comprises a flat belt 140 running between opposing end rollers 162, 164. A conveyor belt drive system, described below, rotates one of the conveyor belt rollers, preferably the discharge end roller, to advance the belt and any stack resting on it toward the discharge plate 166. The conveyor has an automatic drive and control system. See FIG. 6 and the control system flow diagram of FIG. 12. With reference thereto, at plate 166 a first sensor 168, preferably an optical sensor, detects the stack (in the position shown by footprint 174A), and provides a first signal in response thereto. The first signal is processed by the control 169, to stop the drive motor and belt motion. A proximity detector 172 determines the presence or absence of a stack following that which has reached the discharge plate, that is, the stack upstream of the first stack. Preferably the detector is of the capacitative type, detecting through the belt thickness whether there is any mass (stack) at the location indicated by footprint 174B and providing a second signal in response thereto. The combination of first and second signals is analyzed by the control. If the combination of signals indicates that there is a stack at footprint 174A and there is no stack present at footprint 174B, the control system triggers an alarm such as a bell or light, to warn the operator that one or more new stacks are needed on the conveyor; and, to inhibit further motion of the drive motor and belt until a stack is detected at location 174B (or the control is manually overriden).

Figure 10:
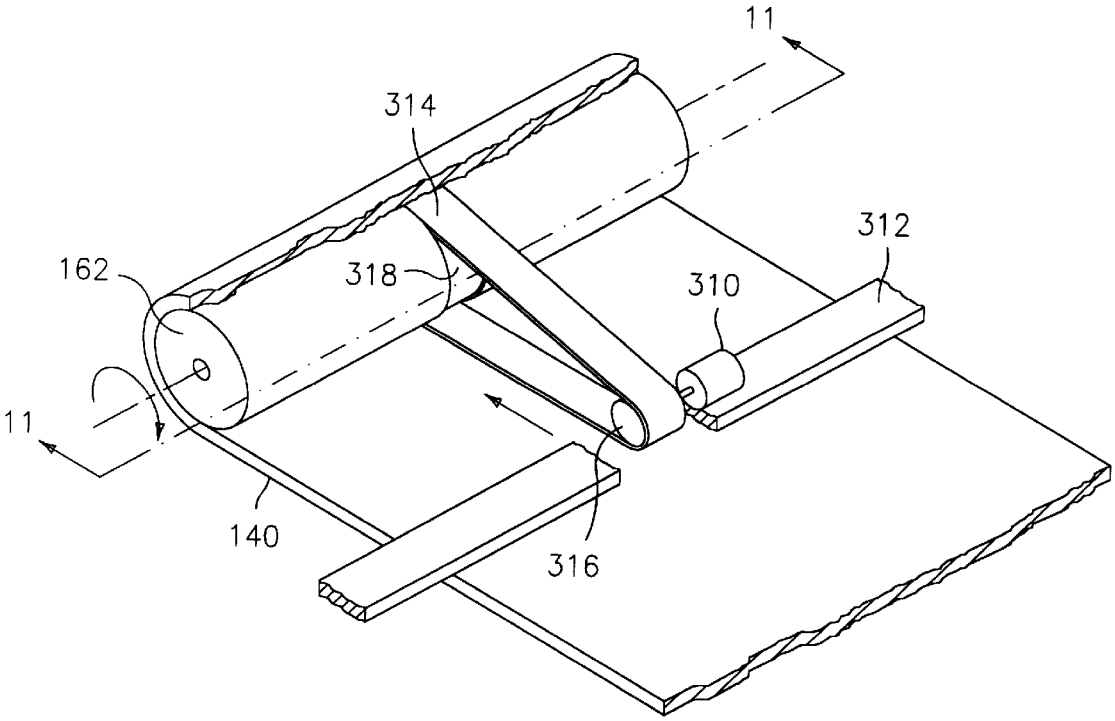
FIG. 10 is a perspective view of portion of the conveyor belt drive system.
Figure 11:
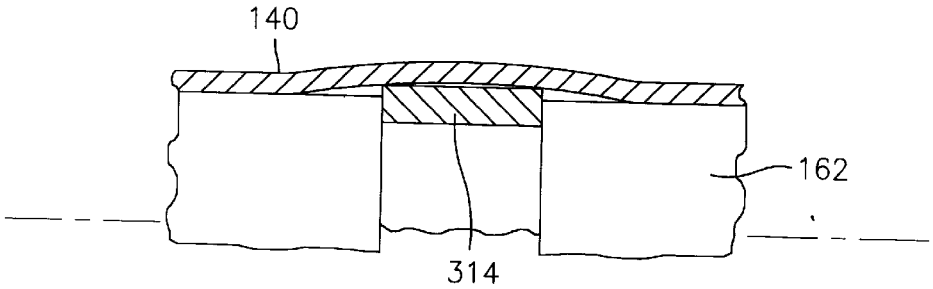
FIG. 11 is a partial cross section elevation view of the apparatus shown in FIG. 10.

The conveyor is driven by a unique drive system illustrated by FIG. 10 and 11. Motor 310 is mounted on beam 312, so it lies between the upper and lower surfaces of conveyor belt 140. The motor drives drum 316, and thus timing belt 314. The timing belt 314 runs in a groove 318 of conveyor belt roller 162 (or alternatively, to roller 164). The groove 318 is smooth bottomed and has a depth less than the thickness of the belt. Thus, as shown in the cross section of FIG. 11, the conveyor belt bears on the surface of the timing belt as it runs around the roller. The friction force between the timing belt and the conveyor belt is the principal force which causes the belt to move, and which causes the roller 126 to rotate. Drive force between the timing belt and the roller groove is relatively incidental. The timing belt surface is raised above the outside diameter surface of the roller. The belt thus "sees" a quasi-crown at the center of the roller, and according to known principles, this aids in keeping the conveyor belt centered on the roller. Thus, the drive is both effective and economic to fabricate. In the generality of the invention, other shape cross section belts may be substituted for the timing belt. And, although less preferred from the standpoint of having the drive belt positively centered on the conveyor roller, the drive belt may be a thin flat belt running around the cylindrical surface of a conveyor roller which has no groove.

Stacks of fanfold paper are loaded onto the conveyor in generally the same way as previously described for the apparatus 20, that is, by being put in a positoner which rotates them through space. The positioner 122 of FIG. 6 is preferably manually powered and the bin 180 which receives a stack of fanfold paper in a carton, stays at essentially a constant elevation above the belt, compared to the rising motion of the bin of positioner 22 in apparatus 20. As shown in FIG. 6, the bin 180 is pivotably mounted by axle 184 between supports 176, 178. The bin is rotated about axis 185 by means of handle 182, from a first orientation, where the open end 147 faces away from the discharge plate end of the conveyor, to a second orientation, where the open end of the bin faces toward the discharge plate end of the conveyor. See FIGS. 7–9. In FIG. 6 the bin is shown in a transient vertical position, as will be explained below. The bin supports have bases 184 with rollers which run within the side rails 138 of the conveyor base, so the positioner can be moved to any desired location along the length of the conveyor.

Figure 7:
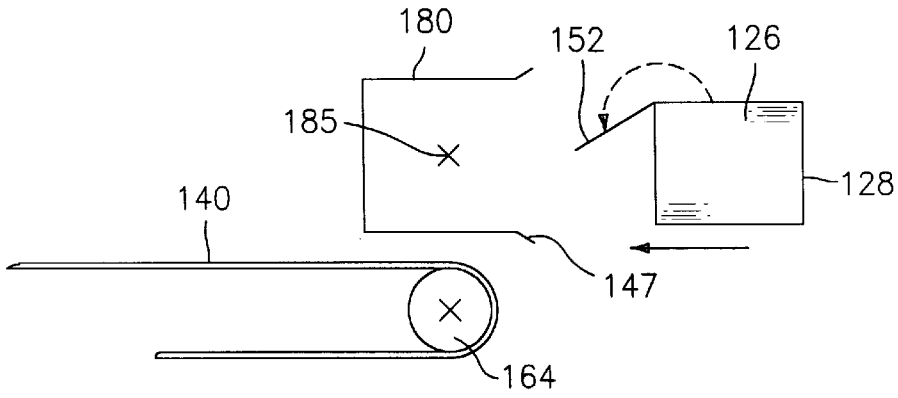
FIGS. 7, 8 and 9 show serial motion of the apparatus shown in FIG. 6.
Figure 8:
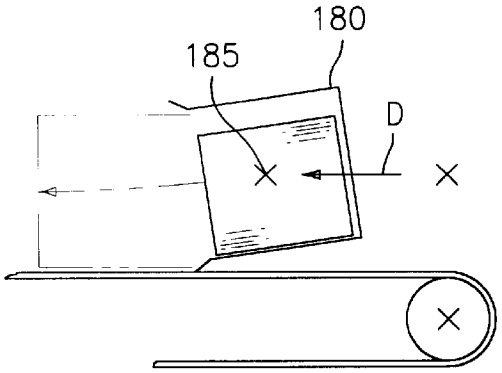
Figure 9:
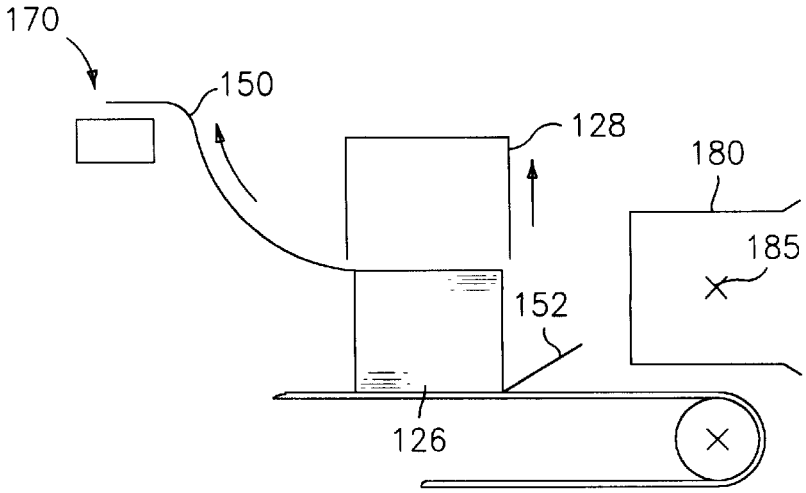

As far as the positioner is concerned in its relation to the conveyor, FIG. 6 is an "exploded view". The positioner normally runs in the rails, and the bin is usually somewhere above the conveyor surface. FIGS. 7–9 are largely schematic, with the positioner bin and carton cut away to expose the stack within, as previously done. FIG. 7 shows the bin 180 in its stored position, ready to receive a carton 128 holding a stack of fan folded sheet 126. A footer 152 is pulled from the top of the stack and the carton is then loaded into the bin as indicated by the arrows. The positioner is then rotated and translated down the conveyor as indicated by arrow D in FIG. 8. When the bin is in the discharge position at the desired location, the carton and stack are then slid from the bin onto the conveyor. Then, as shown in FIG. 9, the positioner and bin are returned to their respective rest positions; the carton is lifted from the stack, and the header pages 150, or lead sheets on the top of the now-inverted stack, are lifted so that the end of the header is engaged with the schematically shown splicer 170.

Figure 22:
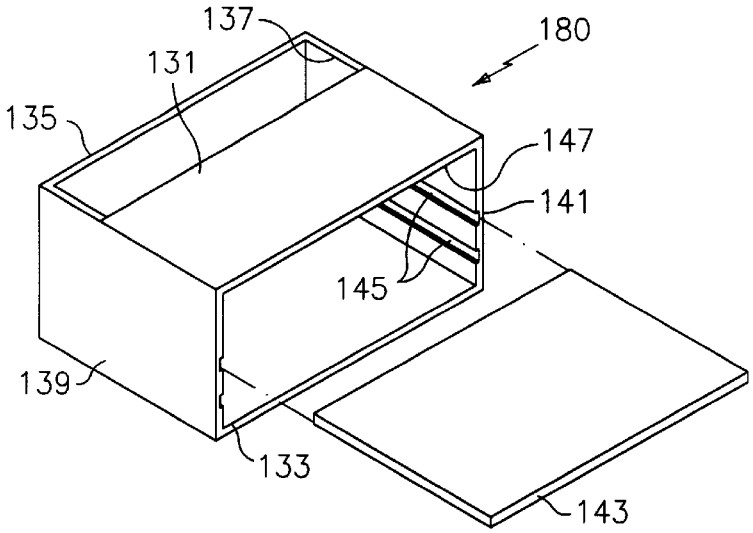
FIG. 22 is a perspective view of a bin variant for use in a postioner of the apparatus of FIGS. 1 and 6.

The bin has a U-shape cross section in the longitudinal vertical plane of the machine base, as evident from FIGS. 6–9. With reference to FIG. 22, a preferred bin 180 has features not shown in the essential bin of FIGS. 6–9. It is comprised of opposing sidewalls 131, 133, a bottom 135, and opposing endwalls 139, 141. The interior surfaces of the endwalls have slots 145 or like means for receiving a partition 143. Thus, the partition may be adjustably set, to raise the surface onto which a stack is slid when being placed into the bin. The partition is used when stacks are significantly less in height than the height of the primary bin opening 147. Thus, the partition 143 functions as a movable sidewall of the bin. When it is in place, it functionally supplants sidewall 133. The partition 143 thus functions similarly to the platform 30 for positioner 22.

As will be evident, the endwalls 139, 141 may be omitted when the partition concept is not utilized, and when the U-shape sidewall and bottom are formed of sufficiently rigid material. The bin 180 also preferably has a sidewall slot opening 137 in the sidewall 131 which is uppermost, when the bin is in its rest position. As described previously, one or more sheets are pulled from the stack to form the footer, prior to the stack being inserted into the bin. When the bin has a slot 137, as the stack/carton are being slid into the bin, the footer is pulled through the slot and captured against the exterior surface of the bottom 135 of the bin by means of a mechanical clip, magnet, or other means. Thus, after rotation and sliding removal of the stack from the bin, there is greater assurance that the footer will be properly positioned and not be waywardly under the stack.

Figure 23:
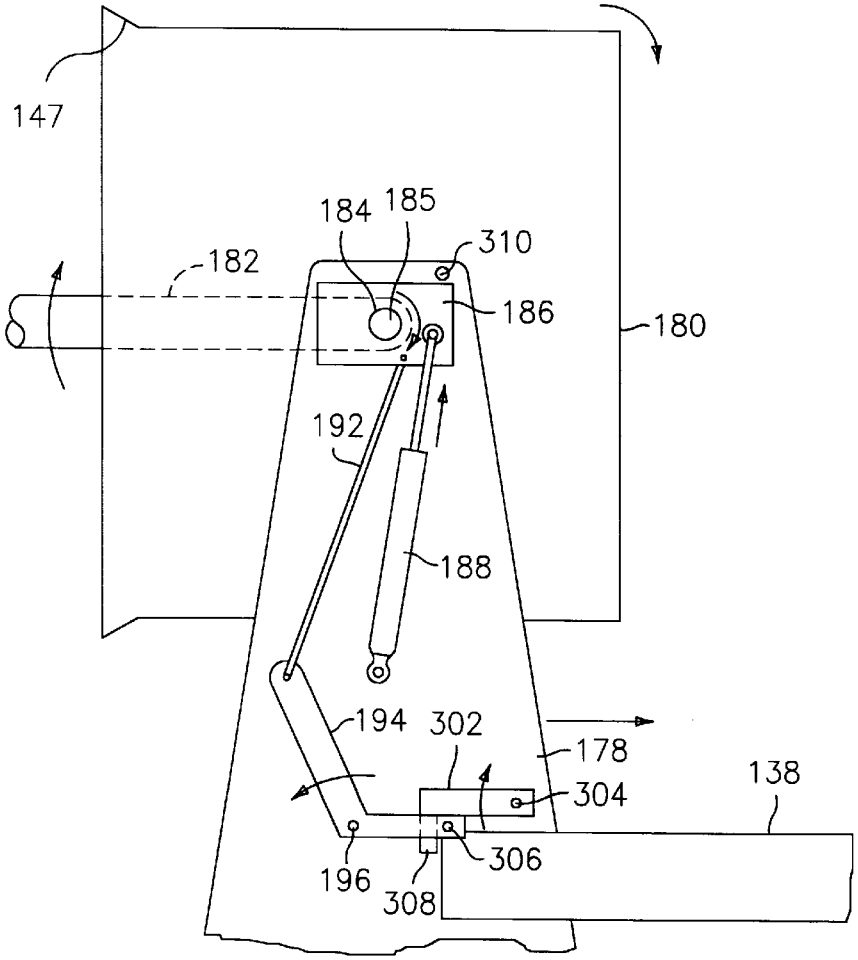
FIG. 23 is an side elevation view of the postioner shown in FIG. 6.

The positioner has mechanism to control both rotation of the bin and translation of the positioner. This is illustrated by the side view of the exterior of the positioner, in particular support 178, in FIG. 23. The bin 180 is fixed to axle 184. Also fixed to the axle is plate 186. Gas spring 188 pushes on the plate to rotate the bin into the rest position, as shown. The rotation of the plate (and bin) is stopped by the stop 310. When the bin is rotated clockwise as indicated in the Figure by the arrow, the spring is compressed until the bin and handle 182 pass through vertical, whereupon the spring 188 causes the bin to continue to rotate about 100 degrees more, to its discharge position, which is determined by an unshown stop like stop 310. A dampener is attached to another plate and the shaft, in similar fashion to the spring, on the opposing side support which is hidden from view in the Figure, to moderate the rate of rotary motion of the bin.

Prior to initiating rotation, the positioner is prevented from translating along the conveyor by the end 308 of latch 302. The latch pivots on pin 304 which is attached to support 178. In its rest position, the latch 302 engages the end of rail 138, and the positioner cannot move lengthwise along the conveyor. The latch is raised by vertical motion of pin 306 which is at the end of L-shape lever 194. This occurs when handle 182 is first moved, to rotate the bin and plate 186, clockwise in FIG. 23. Rod 142, which is connected to plate 186, thrusts downward to rotate lever 194 about pivot 196 which is mounted off support 178. This raises pin 306 and the latch. Thus, when the bin is in its rest position, it will not move while a carton is being inserted. When the operator first moves the lever, to start to rotate the bin, the stop pin 198 is released, and the operator is able to manually translate the positioner along the length of the conveyor, to the location where it is desired to deposit the stack. The operator may complete rotation of the bin at time during or after completion of translation.

Figure 13:
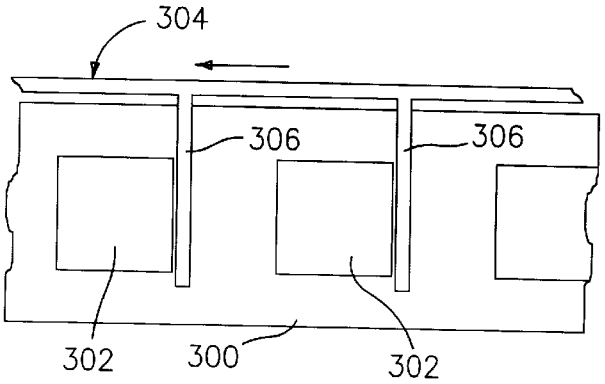
FIG. 13 shows in top view a portion of a transport system for moving stacks which is and alternative to a belt conveyor.

While a belt conveyor is the preferred transport means, or transporter, for moving stacks laterally toward the finishing or printing machine being fed, in the generality of the invention other means for receiving stacks and transporting them laterally toward the printing device may be employed. For instance, in the fragmentary and largely schematic top view of FIG. 13, a static smooth sheet metal surface 300 receives the stacks 302. A mechanical arm assembly 304 is comprised of paddle-like arms 306. The arms have a height nominally equal to the height of the stacks. They extend across the surface 300, to engage the stacks 302 and move them sideways when the arm assembly is actuated to move by a pushing device such as a screw or hydraulic cylinder, not shown, as indicated by the arrow. After the stacks have been advanced, the arms of the assembly 304 are laterally withdrawn so they will clear the surface and the stacks. The arm assembly is then repositioned upstream to its first lengthwise postion, and then moved laterally again so the arms insert beteween the stacks, thus enabling a repeat of the advancing motion for such successive stacks as may be placed on the surface.

Figure 14:
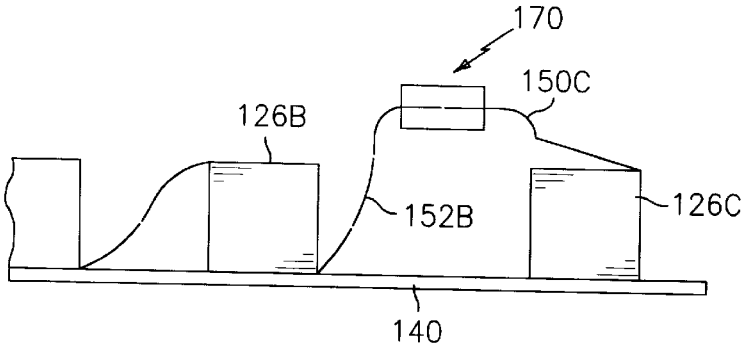
FIG. 14 shows how the headers and footers of sheets from successive stacks resting on a conveyor are joined to each other.
Figure 14A:
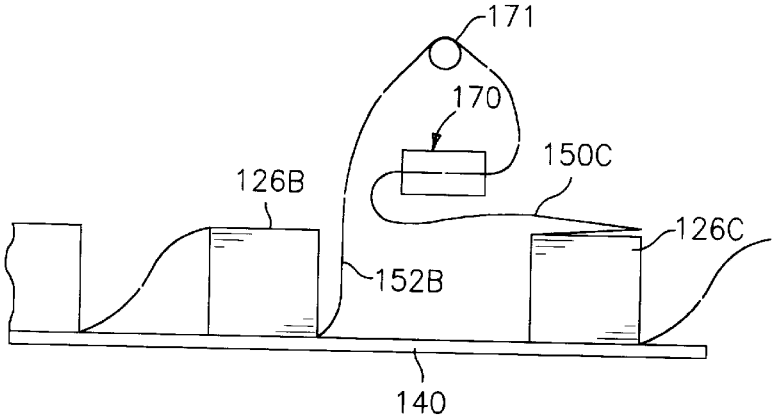
FIG. 14A is similar to FIG. 14, showing how sheets are looped around a support bar above the splicer.

FIG. 14 illustrates schematically how the splicer 170 is used to connect with tape the top pages or header 150C of newly deposited stack 126C with the bottom pages or footer 152B of previously deposited stack 126B. FIG. 14A shows how the footer and header may be looped in a S-shape path and a U-shape path respectively around a cantilever reversing bar 171, mounted at an elevation above the conveyor belt. When the sheet is run as shown, the side of the sheet joint which faces upwardly is reversed. After splicing and removal of the sheet from the splicer and off the reversing bar, the tape will be on the underside of the sheet, insofar as the printer or other device being fed is concerned. The reversing bar is preferably attached to the splicer base so it is a function part thereof In such case the bar runs upwardly from the rear of the base and then forward, to provide the horizontal portion around which the sheet may run.

Figure 15:
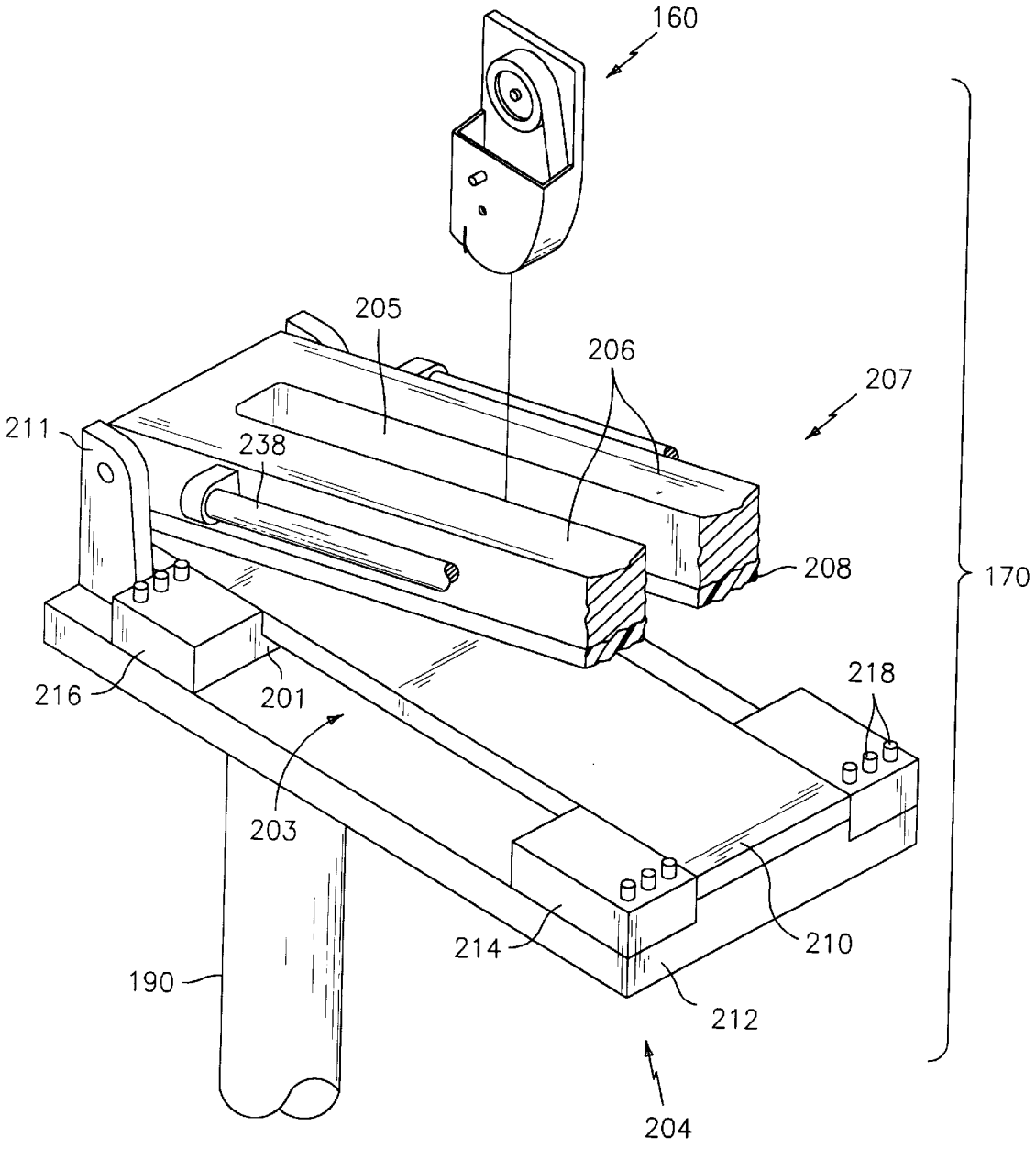
FIG. 15 is a perspective view of the major part of a splicer, mounted on a post, with the top pivoted upward from the base, so it is ready to receive sheets for splicing.
Figure 16:
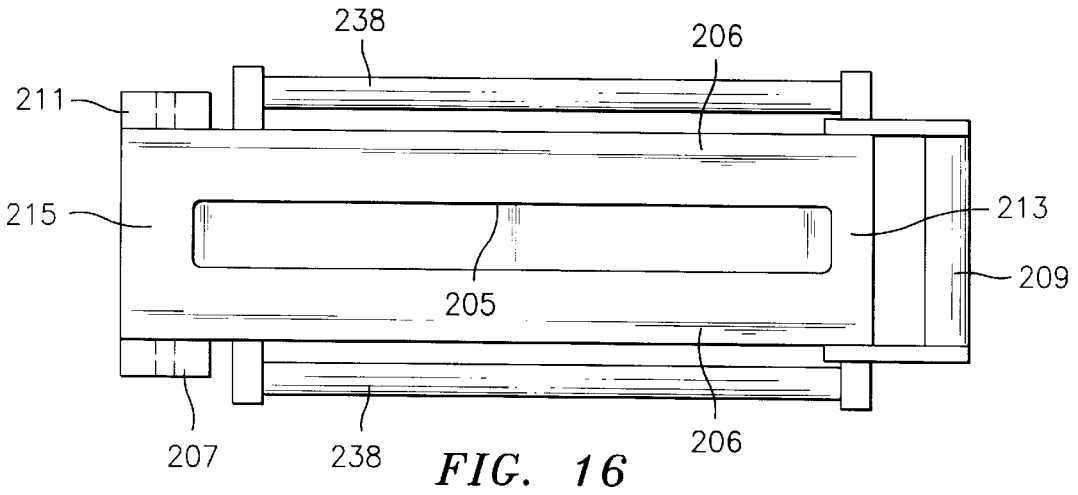
FIG. 16 is a top view of the top of the splicer clamp.
Figure 17:
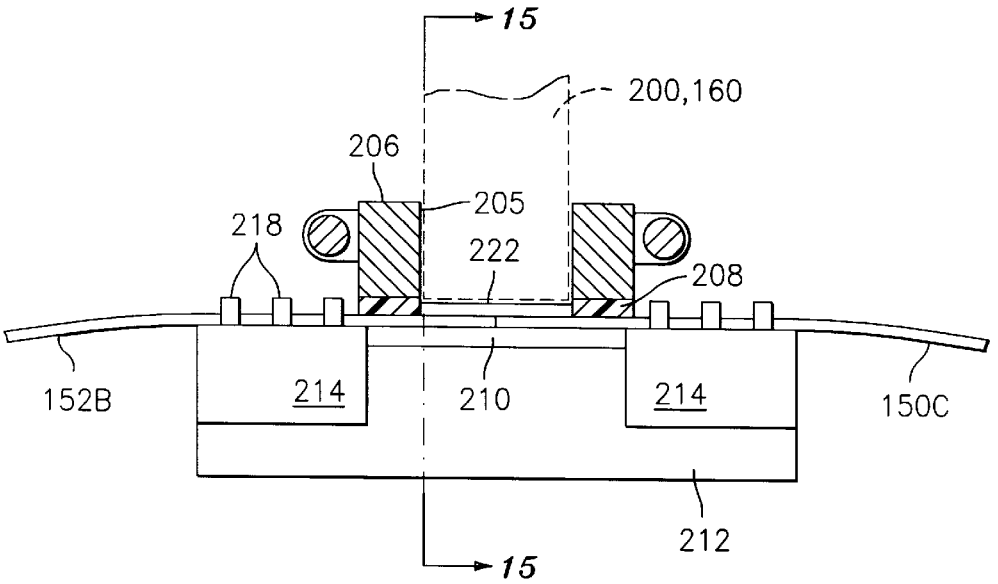
FIG. 17 is an end elevation view of a splicer shown in FIG. 15, from the outer, or front end, showing sheets captured in the clamp assembly, after tape has been laid along the joint between the sheets by the dispenser.

Different configurations of splicers may be used for joining the ends of the sheets. Splicers are extensively described in patent application Serial No. (Atty. No. 9834), entitled "Splicer for Joining Thin Sheets", filed Nov. 6, 1998. The application has some inventors and the assignee in common herewith. The Description, including the drawings, of said application is hereby incorporated by reference. The preferred splicer, which is comprised of a clamp assembly and tape dispenser will be described briefly here. FIG. 15 shows the clamp assembly 170 comprised of a base 212 and a top 207 which is pivoted from the base rear end at uprights 211. The top, shown also in top view in FIG. 16, is comprised of two spaced apart bars 206 running along the length of the base 212, defining a slot 205 therebetween. The underside of each bar is surfaced with a strip 208 of first resilient material, e.g., PVC foam. The top surface of the inverted-tee shape base has a strip 210 of second resilient material, e.g., neoprene rubber. When the top is lowered onto the base to close the clamp assembly, the two layers of first resilient material opposingly mate with the layer of second resilient material, as shown in the end view FIG. 17. Thus, referring to FIG. 17, when the ends of the sheets 152B, 150C which are to be spliced to each other are butted together within the assembly, so the joint lies centrally along the length of the slot in the top, the sheet ends are frictionally held in place by the mating resilient elastomer surfaces. A dispenser 160, for applying tape to the joint, slides lengthwise, and to an extent vertically, within the slot 205 of the top. When the dispenser is moved along the slot, the dispenser lays down and presses down tape along the joint, and automatically cuts it off. Thereafter, the clamp assembly is opened and the spliced sheets are removed.

Preferably, when perforated fanfold sheet is being spliced, the splicer clamp base has a set of blocks 214, 216 on each side. The blocks have pin arrays 218. The rear block 216 is preferably adjustably located along the length of the base, according to the width of paper being joined. The front block 214 has an internal spring mechanism for biasing of the pin array away from the rear block. Thus, as the operator engages the opposing sides of the perforated sheet with the pins of the blocks, the operator manually biases the front block toward the rear block, and releases the biasing force when the perforations of the sheet are engaged with the pin array of the rear block, to thereby tension the sheet prior to closing the clamp.

Figure 19:
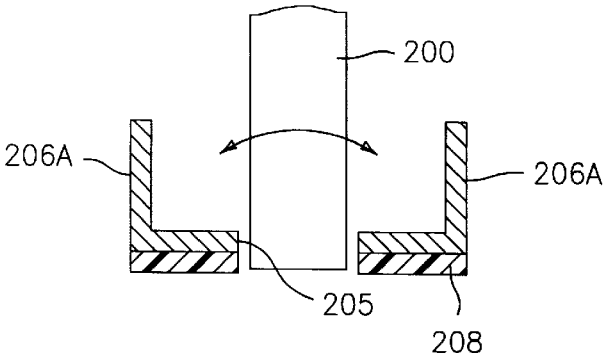
FIG. 19 is an end view of an alternate embodiment top for the clamp.
Figure 18:
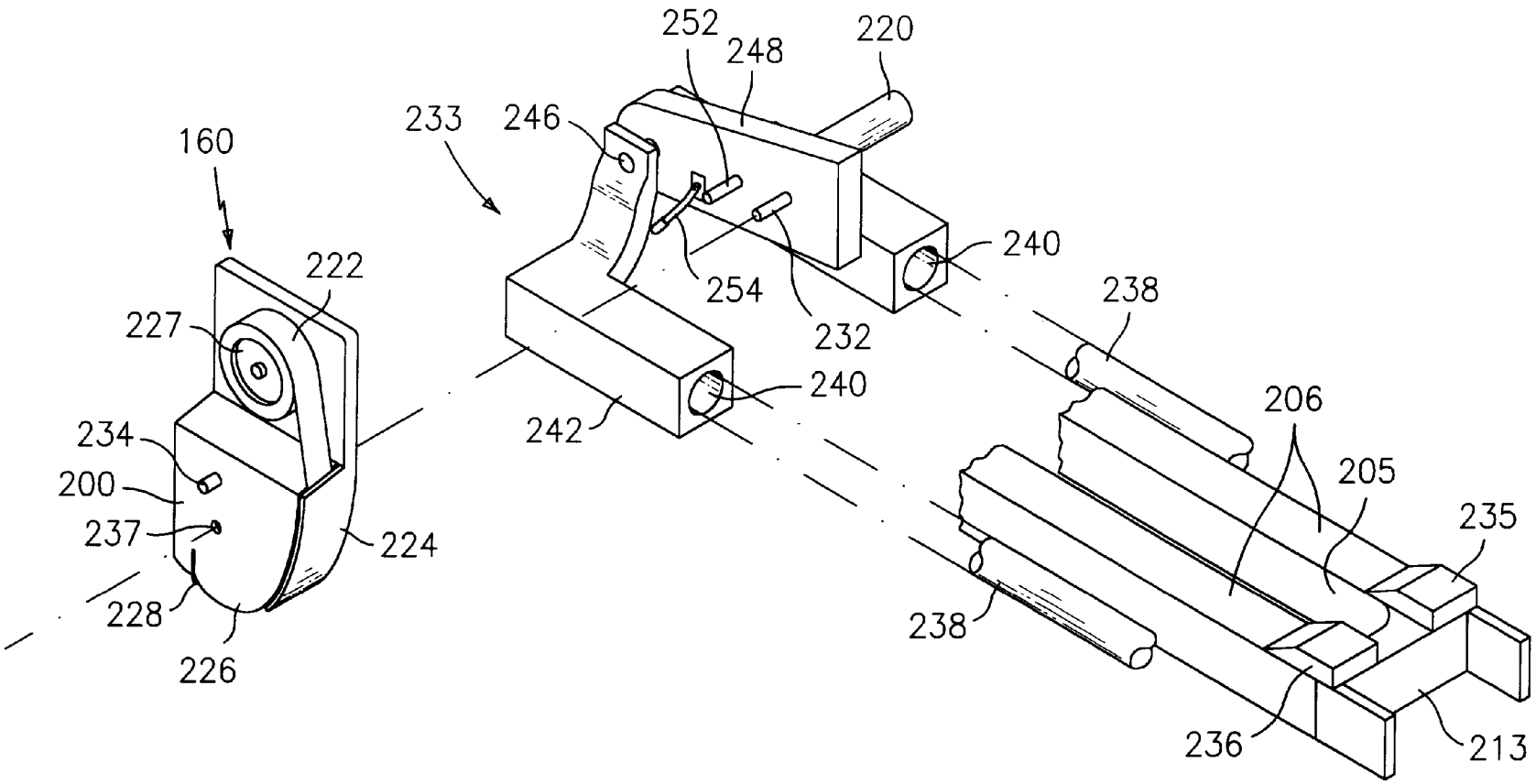
FIG. 18 is an exploded view of a splicer showing how the dispenser mounts on the arm of a carriage which runs along the length of the top of the clamp assembly.

The lower end 200 of the tape dispenser 160 is guided by the slot edges of the top, so it tracks along the joint between the sheets being joined. The tape 222 is fed down the front part of the dispenser and laid on the joint by frictional engagement of the tape with the sheets. The tip or lowermost part of the dispenser presses the tape onto the sheet surface as the dispenser moves along the length of the joint. Preferably, as shown by FIG. 18, the tape dispenser is pivotally mounted with a somewhat loose fit on the pivotable arm 128 of a carriage assembly 233 which is moved manually lengthwise along rods 238 which are on either side of the top. That fit and the fit between the lower end 226 of the dispenser and the slot 205 of the top enables the dispenser to rock slightly in the plane transverse to the dispenser travel path. Thus, the lower end of the dispenser will maintain contact with the sheet joint, as the dispenser lower end runs over small variations and unevenness. The good contact means the tape will be securely laid and adhered. The desired type of fit of the dispenser lower end 200 in the top is achieved in the alternate design of the top, shown in FIG. 19. The bars 206A have right angle cross section shape and provide a relatively short height to slot 205, which is additionally tapered so it is most narrow at its bottom.

A wiper 254 supported off the carriage as shown in FIG. 18, engages the tape just as it has been laid, to ensure that the beginning portion of the tape on the joint is adhered. Near the end of the dispenser travel path along the joint, the dispenser is caused to rotate and lift, preferably by two cams on the base which are engaged by pins extending from the dispenser and carriage. A first cam engages a pin on the dispenser rotating it slightly in the longitudinal vertical plane of the top. A second cam engages the arm on which the dispenser is mounted lifting it slightly. The rotating and lifting motion cause a knife 228 located rearward of the dispenser bottommost tip to contact and cut the tape. The motions also cause the dispenser lower tip to lift and cause the dispenser trailing edge to contact the tape, to ensure that the last part of the tape which is laid down will be pressed onto the sheet surface.

Then, the top 207 is pivoted upwardly, carrying with it the dispenser and carriage—which may then be returned to the starting point—and the joined sheets are removed from the splicer. The splicer then may be translated backward, across the conveyor, to a storage position, and to enable the now-continuous sheet to be lowered to the conveyor surface.

The splicer may be a separate unit, mounted on the column 190 which extends upwardly from a dolly having four caster wheels. More preferably, the clamp assembly 204 of the splicer mounts so it becomes a functional part of the feeder. For instance, it mounts on the column 190 which runs along the conveyor base, in a manner which enables (a) translation of the splicer lengthwise along the conveyor; (b) translation transverse to the length of the conveyor; (c) rotation in a 180 degree or more arc about the column; and (d) vertical motion to change elevation. All such motions are indicated by arrows in FIG. 6 and some other Figures.

Figure 20:
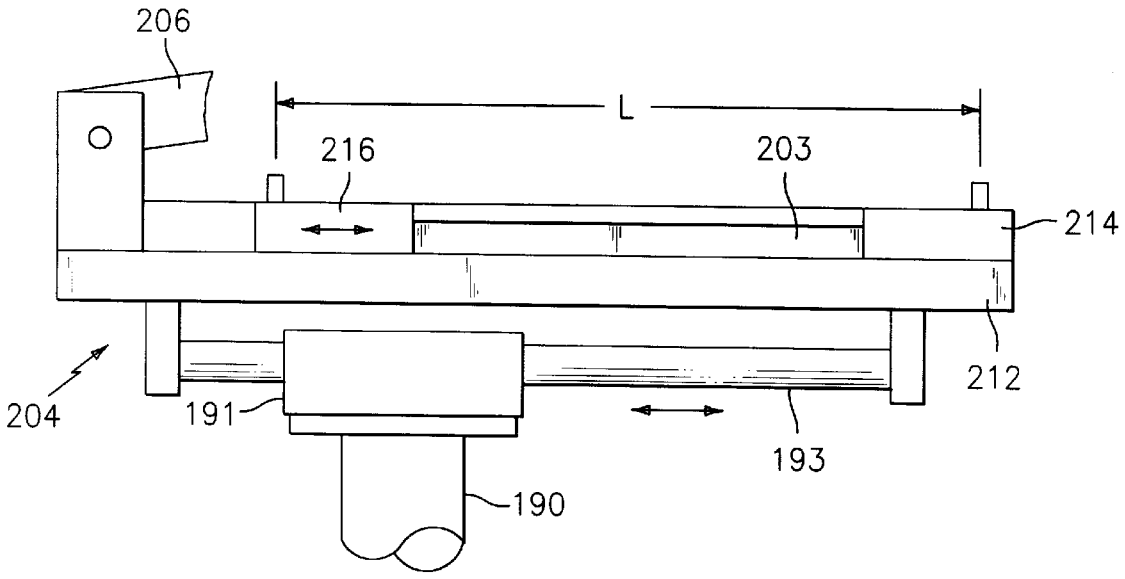
FIG. 20 is a side view of the base of a splicer clamp assembly mounted on a column, where the assembly translates horizontally relative to the post.

As shown in FIG. 20, to the top of column 190 is attached an optional part of the splicer, block 191, which has two bore holes to slidably receive the two rods 193 attached to the underside of the clamp assembly base 212. This construction enables the splicer to move across the width of the conveyor.

Thus, the splicer can be accurately positioned to receive the header and footer when the location of the stack on the conveyor varies laterally, or when the width of the sheet varies from job to job.

Figure 21:
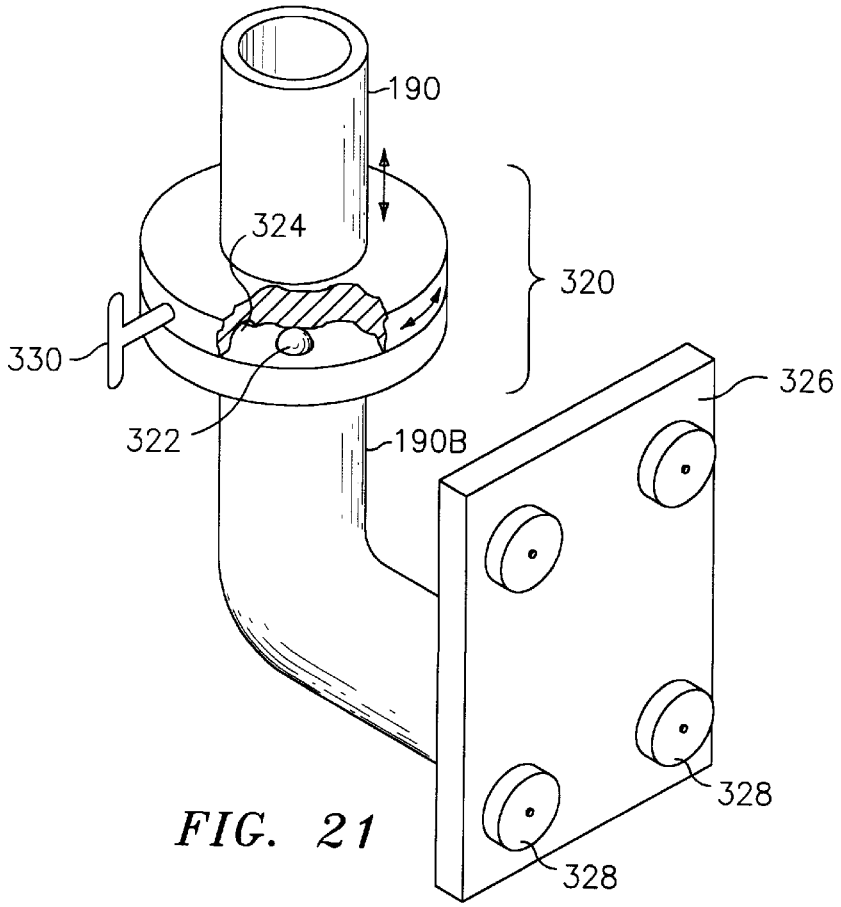
FIG. 21 is a perspective view of the base of the mounting post for the splicer shown in FIG. 6, showing the fitting which enables rotation and vertical motion of the post.

FIG. 21 shows how at the lower end of the column 190 has a pivotable connection 320 to a bent stub column 190B which is fastened to the column carriage 326. The carriage 326 has four wheels 328 which run in the track of the base side rail 138 of the conveyor, enabling the splicer to move lengthwise along the conveyor belt. See FIG. 6.

The pivot connector 320 enables both rotary and vertical motion of the splicer. The connector has an upper flange engaged with the column 190 and a lower flange engaged with the column 190B which flanges are able to rotate relative to each other. Spring loaded detent balls 322 in the lower flange engage pockets 324 in the upper flange, so the column 190 and thus the splicer will stay in preset rotary positions relative to the stub column 190B, and thus the conveyor. When not being used, the splicer may be rotated out of working position, with its length parallel to the length of the conveyor. The column 190 is vertically slidable lengthwise through the connector flanges, to enable the vertical elevation of the column to be changed. Locking screw 330 in the upper flange engages the column to fix the elevation as desired.

Although this invention has been shown and described with respect to the preferred embodiments, it will be understood by those skilled in the art that various changes in form and detail thereof may be made without departing from the spirit and scope of the claimed invention.

We claim:

1. Apparatus for feeding stacks of fanfold sheets comprising:

a) a transporter, having a base, a length, an input end, an opposing discharge end, a fanfold stack support surface running lengthwise, and means for moving stacks laterally along the support surface toward the discharge end; and, b) a positioner, for receiving, rotating in space, and depositing stacks on the transporter surface, translatable along a portion of the length of the transporter;

wherein the positioner is comprised of a U-shape bin, adapted to receive a stack of fanfold sheets; the bin having sidewalls, a bottom, and a primary opening opposite the bottom; the bin rotatable upon the positioner, from a first position wherein the primary opening thereof faces away from the discharge end of the transporter, to a second position wherein said opening faces toward the discharge end of the transporter.

2. The apparatus of claim 1 further comprising a bin sidewall having an opening shaped as a slot, to enable passage therethrough of the end of the sheet of a fanfold stack placed within the bin, when the bin is in its first position.

3. The apparatus of claim 1 wherein the transporter is a belt conveyor comprising a conveyor belt running between a first roller and a second roller, one each roller located at an opposing end of the transporter, and wherein the stack support surface is the belt.

4. The apparatus of claim 1 wherein the base is suited for mounting the apparatus on a floor surface so that the stack support surface is elevated above said floor surface; the apparatus further comprising a positioner mounted on the base and translatably running lengthwise therealong; the bin first position located proximate the floor surface; wherein the bin, during rotation from the first to the second position, rises upwardly from proximity of the floor surface to proximity of the stack supporting surface.

5. The apparatus of claim 1 wherein one of said sidewalls is slidable transverse to the bottom of the bin in a direction away from the bin opening, so that when the bin is in said second position, sliding away the sidewall causes any stack within the bin to be deposited on the stack supporting surface.

6. The apparatus of claim 1 further comprising a partition; the bin having endwalls connecting said sidewalls, the endwalls having means for slidably receiving said partition in a position wherein the partition runs between the endwalls and parallel to the sidewalls; the partition providing a surface on which a stack may be placed when inserted into the bin opening.

7. The apparatus of claim 1 further comprising rail means, for supporting the positioner at a desired lengthwise location, the rail means running lengthwise along the base; wherein the postioner is mounted on said means.

8. The apparatus of claim 7 further comprising means for locking the positioner in place along said rail mean, to prevent translation, when the bin is in the first position; and, means for releasing said means for locking in response to initiation of rotation of the bin from the first position toward said second position.

9. The apparatus of claim 7 further comprising a splicer, the splicer mounted on and running along said rail means, the splicer located in between the positioner and the discharge end of the transporter.

10. The apparatus of claim 1 further comprising a splicer located at an elevation above the stack supporting surface, between the input end and the discharge end of the transporter.

11. The apparatus of claim 10 having a splicer mounted off the base, the splicer movable, with respect to the stack supporting surface, in the lengthwise, transverse to the lengthwise direction, vertically, and rotationally about a vertical axis.

12. The apparatus of claim 10 further comprising reversing bar means for supporting sheet in space at an elevation above the splicer, wherein when there are adjacent stacks on the stack supporting surface and sheet is run between said stacks and and through the splicer running of sheet over said reversing bar means makes the sheet follow an S-curve, so the upper surface of the sheet is reversed from what it would be in the absence of the means for supporting.

13. The apparatus of claim 3 further comprising a drive system, for moving the conveyor belt about the rollers; said drive system comprising a motor, for powering the conveyor belt motion, wherein running of the motor is responsive to a signal from a controller; a first sensor for providing a signal responsive to the presence of a first fanfold stack at the discharge end of the transporter; a second sensor for providing a signal in response to presence of a second fanfold stack at a location along the stack supporting surface length which is further from the discharge end of transporter than said first fanfold stack; a controller, for providing a signal to a motor responsive to signals from said sensors; and, an alarm, responsive to a signal from the controller; wherein a combination of said signals indicating the presence of said first stack and the lack of presence of said second stack causes the motor to cease running and signals said alarm.

14. The apparatus of claim 3 wherein the first roller is connected to a conveyor drive assembly, for moving the conveyor belt and fanfold stacks placed thereon toward the discharge end of the belt conveyor; the drive assembly comprising a rotatable drive pulley, means for rotating the drive pulley, an endless drive belt running between the drive pulley and said first roller, wherein the drive belt is captured between the roller surface and the conveyor belt as the drive belt runs around the first roller, the thickness of the drive belt sufficient to lift the conveyor belt up from contact with the surface of the roller, to thereby cause frictional engagement between the drive belt and the conveyor belt when the drive belt is moved.

15. The apparatus of claim 3 wherein the first roller has a circumferential groove; the drive belt running in said groove.

16. The apparatus of claim 1 further comprising a stanchion located at the discharge end, the stanchion having at least two rollers for supporting sheet drawn from fanfold stacks.

17. The apparatus of claim 16 wherein sheet running along a path around the rollers creates a force on the roller due to tension in the sheet, characterized by: one of said rollers movable against a spring bias force, wherein sufficient increase in the tension of the sheet causes the roller to move.

* * * * *